US006605893B2

(12) United States Patent
Ando

(10) Patent No.: US 6,605,893 B2
(45) **Date of Patent: *Aug. 12, 2003**

(54) VACUUM CONTAINER, METHOD OF MANUFACTURE THEREFOR, AND FLAT IMAGE DISPLAY APPARATUS PROVIDED WITH SUCH VACUUM CONTAINER

(75) Inventor: Tomokazu Ando, Isehara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/507,048

(22) Filed: Feb. 22, 2000

(65) Prior Publication Data

US 2003/0090196 A1 May 15, 2003

(30) Foreign Application Priority Data

Feb. 25, 1999 (JP) ..... 11-049069
Feb. 17, 2000 (JP) ..... 2000-039649

(51) Int. Cl.[7] ..... H01J 17/49
(52) U.S. Cl. ..... 313/495; 313/422; 313/553; 313/634; 313/582
(58) Field of Search ..... 313/495, 496, 313/497, 422, 553, 560, 561, 634, 582, 493

(56) References Cited

U.S. PATENT DOCUMENTS 5,831,387 A 11/1998 Kaneko et al. ..... 313/495
5,952,775 A 9/1999 Sato et al. ..... 313/422
6,111,351 A * 8/2000 Pong et al. ..... 313/495
6,191,529 B1 * 2/2001 Park ..... 313/553

FOREIGN PATENT DOCUMENTS

| | | |
|---|---|---|
| EP | 0 660 357 | 6/1995 |
| EP | 0 780 875 | 6/1997 |
| JP | 7-235255 | 9/1995 |
| JP | 9-231924 | 9/1997 |
| KR | 1995-34368 | 12/1995 |
| KR | 1996-0002432 | 1/1996 |

* cited by examiner

*Primary Examiner*—Sandra O'Shea
*Assistant Examiner*—Bao Truong
(74) *Attorney, Agent, or Firm*—Fitzpatrick, Cella, Harper & Scinto

(57) ABSTRACT

A vacuum container for a flat image display apparatus includes a rear substrate having an electron-emitting device mounted thereon, a face substrate arranged to face the rear substrate, having thereon a phosphor emitting light when the electron emitted from the electron-emitting device collides therewith, and an outer frame arranged between the dace substrate and the rear substrate. For this vacuum container, the outer frame is provided with a plurality of frame members. With the structure thus arranged, this vacuum container contributes significantly to manufacturing a light weight, but highly robust flat image display apparatus at lower cost. By providing a plurality of frame members for the outer frame portion, thinner substrates can be utilized with a good sealing mechanism, while securing the sufficient robustness of the edge circumference of the vacuum container.

19 Claims, 9 Drawing Sheets

VACUUM CONTAINER, METHOD OF MANUFACTURE THEREFOR, AND FLAT IMAGE DISPLAY APPARATUS PROVIDED WITH SUCH VACUUM CONTAINER

BACKGROUND OF THE INVENTION

1. Field of the Invention

The present invention relates to a flat image display apparatus used as an apparatus for displaying characters or images as a display, a message board, or the like used for a television receiver or a computer, among some others. The invention also relates to a vacuum container provided for the flat image display apparatus, and a method of manufacture therefor as well.

2. Related Background Art

The flat image display apparatus has advantages such that the apparatus is not bulky when set up in a room or the like, its appearance is good, and it is compact to make the required operation efficient when incorporating it in various kinds of equipment. This apparatus is, therefore, utilized as an apparatus to display characters or images as display, a message board, or the like used for a television receiver or a computer, among some others. Further, with a higher set-up freedom, it is practiced to hang up the apparatus on the wall or set it into the ceiling or the like.

In the recent years, there have been produced and used as the flat image display apparatuses which utilize electron emission, such as the surface conduction electron-emitting display (hereinafter referred to as the "SED"), not to mention the field emission display that utilizes the field emission of electron.

FIG. 12 is a cross-sectional view which shows a vacuum container to illustrate the conventional example of the SED, that is, one of the flat image display apparatuses described above.

In FIG. 12, a reference numeral 101 designates the face substrate that mounts thereon a phosphor 104; 102, the rear substrate arranged to face the face substrate 101, which mounts thereon the electron-emitting device 105; 103, the outer frame arranged between the face substrate 101 and the rear substrate 102; 107, the frit glass that forms a closed container by adhesively bonding the face substrate 101, the rear substrate 102, and the outer frame 103; and 106, the vacuum container which comprises the face substrate 101, the rear substrate 102, the outer frame 103 and the frit glass 107. The inner pressure of the vacuum container 106 is the vacuum of as high as $8\times10^{-7}$ Pa or less, and the high vacuum is maintained by the provision of the getter members which are not shown.

The specific technologies and techniques of the flat image display apparatus, and the vacuum container described above are disclosed in Japanese Patent Application Laid-Open No. 7-235255 and others.

The outer frame 103 is vacuum sealing means together with the frit glass 107. Then, it also serves as means for regulating the distance between the face substrate 101 and the rear substrate 102. Currently, it is demanded to make the substrates, such as the face substrate 101 and the rear substrate 102, thinner still in order to lighten and thin the flat image display apparatus more. However, the utilization of a thinner substrate may lead to the lowered robustness of the vacuum container 106, that is, the vacuum container 106 is subjected to a greater warping due to its own weight eventually. As a result, there is a need for the provision of facilities to carry the vacuum containers 106 more carefully at the time of manufacture, which inevitably leads to the higher costs of manufacture.

In order to secure the robustness of the vacuum container 106, it is required to make the frame width of the outer frame 103 wider, among some other measures.

However, if the outer frame 103 should have a wider width, the coating of the frit glass 107 tends to become uneven, thus inviting the generation of air bubbles in the interior thereof when the vacuum sealing is executed uniformly with the adhesive bonding using the frit glass 107. As a result, there occurs the slow leakage of vacuum or some other drawback. Such drawbacks may result in the problem of the lower production yield.

SUMMARY OF THE INVENTION

With a view to solving the problems discussed above, the present invention is designed. It is an object of the invention to provide a light weight, and highly robust vacuum container having a good sealing function.

In order to achieve the object, the vacuum container of the present invention for a flat image display apparatus comprises a rear substrate having an electron-emitting device mounted thereon; a face substrate arranged to face the rear substrate, having thereon a phosphor emitting light when the electron emitted from the electron-emitting device collides therewith; and an outer frame arranged between the face substrate and the rear substrate. For this vacuum container, the outer frame is provided with a plurality of frame members.

Also, for the vacuum container of the present invention described above, the outer frame portion is provided with a first frame member enclosing the electron-emitting device, and a second frame member enclosing the first frame member, and the first frame member, the face substrate, and the rear substrate surround and form a first imaging space, and the first frame member, the second frame member, the face substrate, and the rear substrate surround and form a first interframe space.

Further, for the vacuum container of the present invention described above, the outer frame portion is provided further with a third frame member enclosing the second frame member, and the second frame member, the third frame member, the face substrate, and the rear substrate surround and form a second interframe space.

Further, for the vacuum container of the present invention described above, getter means is arranged in the first interframe space.

Further, for the vacuum container of the present invention described above, getter means is arranged in the second interframe space.

Further, for the vacuum container of the present invention described above, a cut-out structure is provided for the first frame member, and the imaging space and the first interframe space are continuous.

Further, for the vacuum container of the present invention described above, the imaging space and the first interframe space are independent.

Further, for the vacuum container of the present invention described above, a cut-out structure is provided for the second frame member, and the first interframe space and the second interframe space are continuous.

Further, for the vacuum container of the present invention described above, the first interframe space and the second interframe space are independent.

Further, for the vacuum container of the present invention described above, the cut-out structure is a cut-out groove.

Further, for the vacuum container of the present invention described above, the cut-out structure is a gap.

Further, for the vacuum container of the present invention described above, a part of the plural frame members is an air-tight frame.

Further, for the vacuum container of the present invention described above, a non-air-tight frame is provided for the inner side of the air-tight frame.

Further, for the vacuum container of the present invention described above, getter means is provided for the inner side of the air-tight frame.

Further, for the vacuum container of the present invention described above, non-air-tight frame is provided for the outer side of the air-tight frame.

Further, for the vacuum container of the present invention described above, the plural frame members are glass.

Further, for the vacuum container of the present invention described above, the plural frame members are frit glass.

Further, for the vacuum container of the present invention described above, the sectional shape of the plural frame members is substantially square.

Further, for the vacuum container of the present invention described above, the electron-emitting device is a surface conduction electron-emitting device.

Further, for the vacuum container of the present invention described above, the electron-emitting device is a field emission electron-emitting device.

Further, for the vacuum container of the present invention described above, the frame member is a frame member formed by bending a substrate.

Further, for the vacuum container of the present invention described above, the frame member is a frame member formed by bending a hot drawn substrate.

Further, for the vacuum container of the present invention described above, the frame member is a frame member formed by bonding a plurality of substrates.

Also, for the method of the present invention for manufacturing the vacuum container described above comprises the steps of arranging the face substrate and the rear substrate to face each other in a vacuum atmosphere; arranging the plural frame members between the face substrate and the rear substrate; and bonding the face substrate, the rear substrate, and the plural frame members.

Also, the flat image display apparatus of the present invention comprises the vacuum container described above.

DETAILED DESCRIPTION OF THE PREFERRED EMBODIMENTS

Now, hereinafter, with reference to the accompanying drawings, the description will be made of the embodiments in accordance with the present invention.

First Embodiment

FIGS. 1A, 1B, 2, 3, 4A, 4B, 5A and 5B are views which illustrate the vacuum container, the method of manufacture thereof, and the flat image display apparatus that utilizes such vacuum container in accordance with one embodiment of the present invention.

Figure 1A:
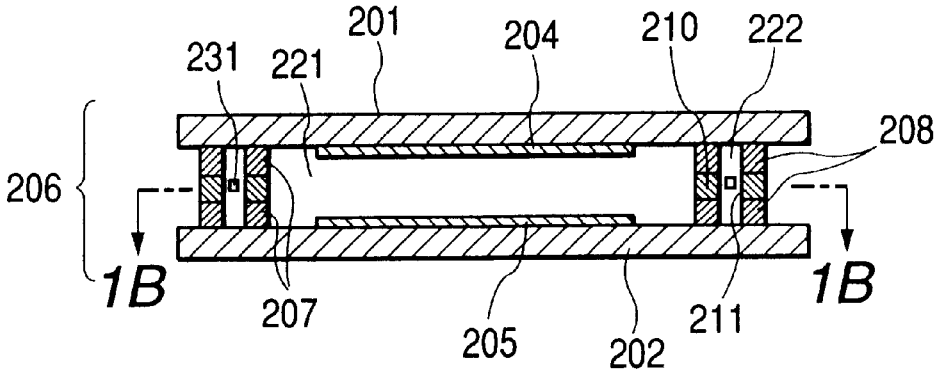
FIGS. 1A and 1B are cross-sectional views which schematically illustrate a first embodiment in accordance with the present invention.
Figure 1B:
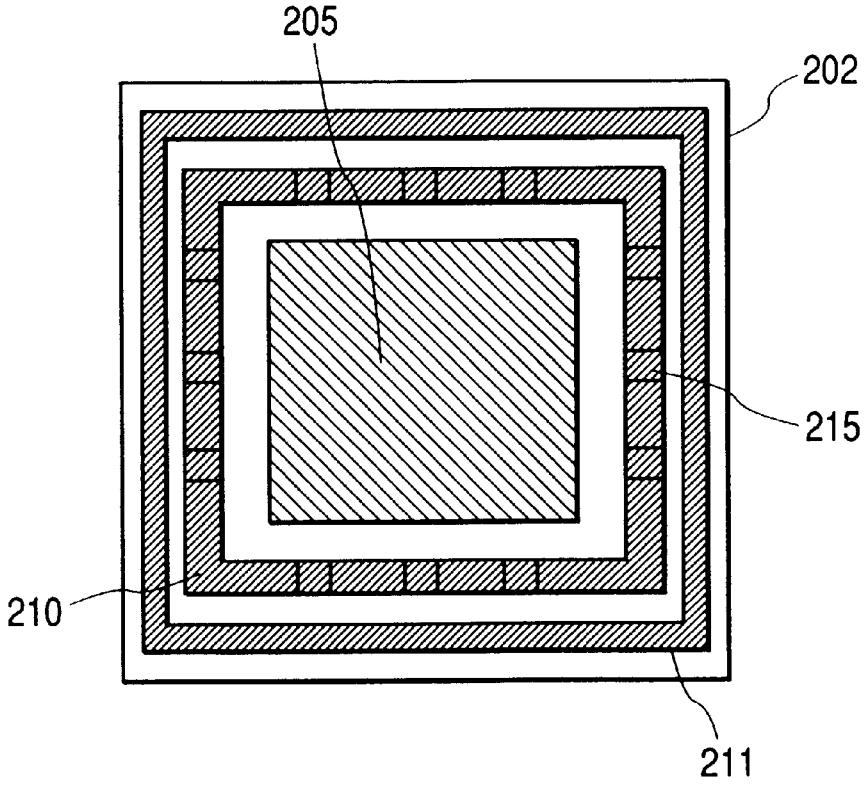

FIGS. 1A and 1B are views which illustrate the flat image display apparatus in accordance with the present embodiment.

In FIGS. 1A and 1B, a reference numeral 201 designates the face substrate which mounts the phosphor 204 thereon; 202, the rear substrate which is arranged to face the face substrate 201 to mount the electron-emitting device 205 thereon, which is called a surface conduction electron-emitting device; 210, a first frame arranged between the face substrate 201 and the rear substrate 202; 211, a second frame arranged between the face substrate 201 and the rear substrate 202 to enclose the first frame 210; 207, the frit glass that adhesively bonds the face substrate 201, the rear substrate 202, and the first frame 210; and 208, the frit glass that adhesively bonds the face substrate 201, the rear substrate 202, and the second frame 211. Also, a reference numeral 206 designates the vacuum container which comprises the face substrate 201, the rear substrate 202, the first frame 210, the second frame 211, and the frit glasses 207 and 208.

A reference numeral 221 designates an imaging space which is surrounded by the first frame 210, the face substrate 201, and the rear substrate 202 to be in contact with the phosphor 204 and the electron-emitting device 205; and 222, a first interframe space which is surrounded by the first frame 210, the second frame 211, the face substrate 201, and the rear substrate 202.

A reference numeral 215 designates a cut-off groove provided for the first frame 211; 231, a first getter which is the Ba ling getter supported by the getter supporting member (not shown) (the details of which are disclosed in the specification of Japanese Patent Application Laid-Open No. 9-231924).

Now, the method of manufacture will be described.

Figure 2:
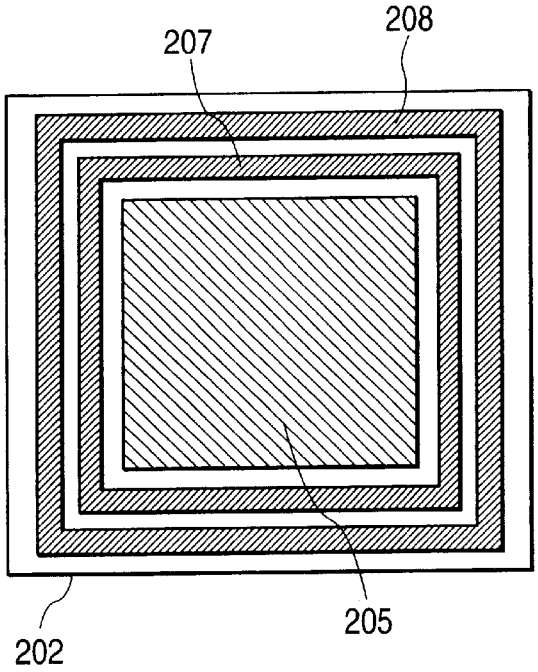
FIG. 2 is a view which illustrates the first embodiment, and which shows the unit assembly of the rear substrate 202 represented in FIGS. 1A and 1B in particular.

At first, the frit glasses 207 and 208 are coated on the rear substrate 202. FIG. 2 shows the coating positions of the frit glasses. FIG. 2 is a view which illustrates the rear substrate 202. On the rear substrate 202 (a soda lime glass of 100 mm×100 mm in a thickness of 2.3 mm) having the electron-emitting device 205 mounted thereon in advance, the frit glasses 207 and 208 are coated by a dispenser in a size of 2 mm wide and 0.4 mm thick.

Figure 3:
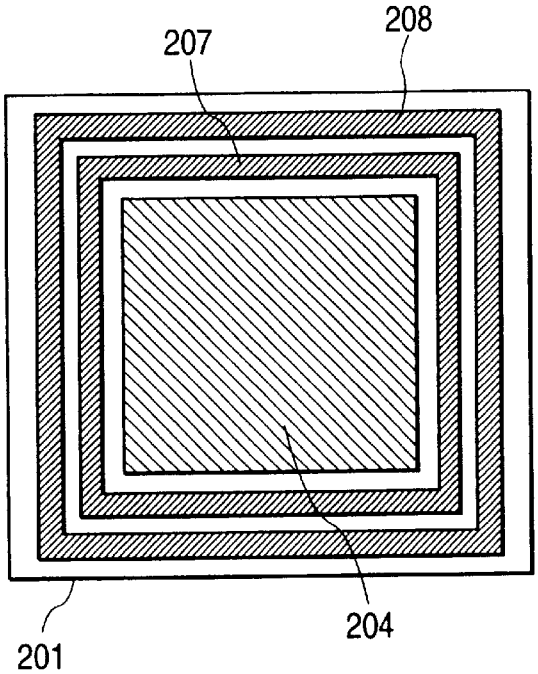
FIG. 3 is a view which illustrates the first embodiment, and which shows the unit assembly of the face substrate represented in FIGS. 1A and 1B in particular.

Then, on the face substrate 201, the frit glasses are coated. FIG. 3 shows the coating positions of the frit glasses. FIG. 3 is a view which illustrates the face substrate 201. On the face substrate 201 (a soda lime glass of 100 mm×100 mm in a thickness of 2.3 mm) having the phosphor 204 mounted thereon in advance, the frit glasses 207 and 208 are coated by a dispenser in a size of 2 mm wide and 0.4 mm thick.

The coating position of the frit glass 207 is almost in agreement with the shape of the first frame 210, and the coating position of the first glass 208 is almost in agreement with the shape of the second frame 211.

Figure 4A:
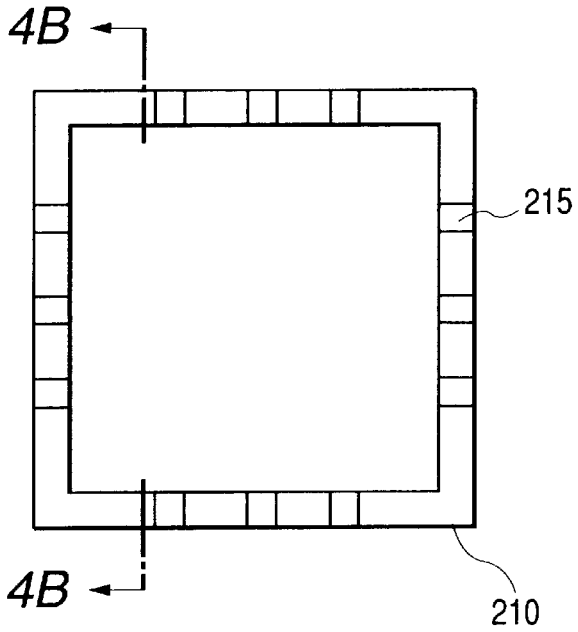
FIGS. 4A and 4B are views which illustrate the first embodiment, showing particularly a first frame 210 in FIGS. 1A and 1B.
Figure 4B:
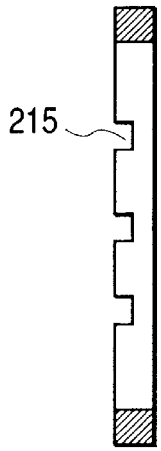

FIGS. 4A and 4B are views which illustrate the first frame 210. The outer dimension of the first frame 210 is 88 mm×88 mm, 2 mm wide and 2 mm thick, which is formed by soda lime glass. The cut-off groove 215 is arranged to make the imaging space 221 and the first interframe space 222 a continuous space. The width of the cut-off groove 215 is 5 mm. Three grooves are arranged on one side at intervals of 15 mm. There are 12 cut off grooves in total.

Figure 5A:
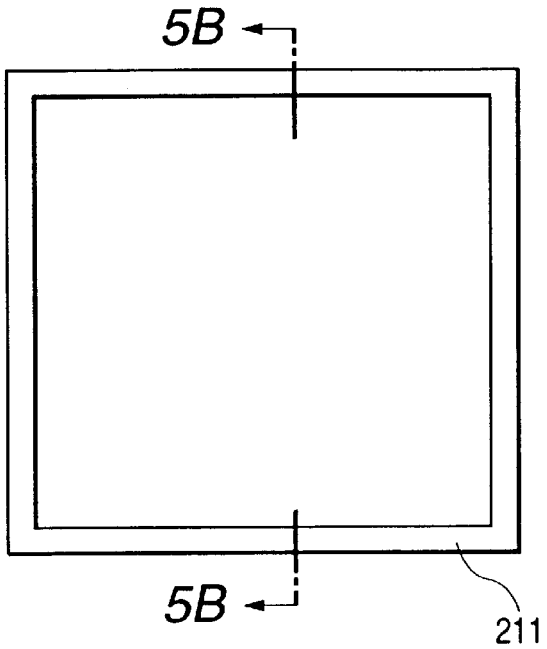
FIGS. 5A and 5B are views which illustrate the first embodiment, showing particularly a second frame 211 in FIGS. 1A and 1B.
Figure 5B:
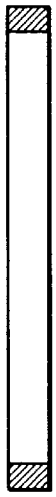
Figure 6A:
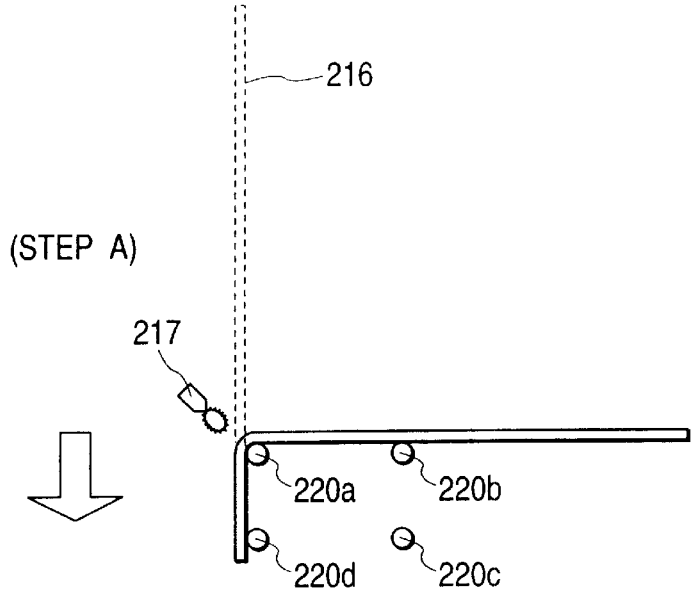
FIGS. 6A, 6B, 6C and 6D are views which illustrate a first method for forming the first and second frames.
Figure 6B:
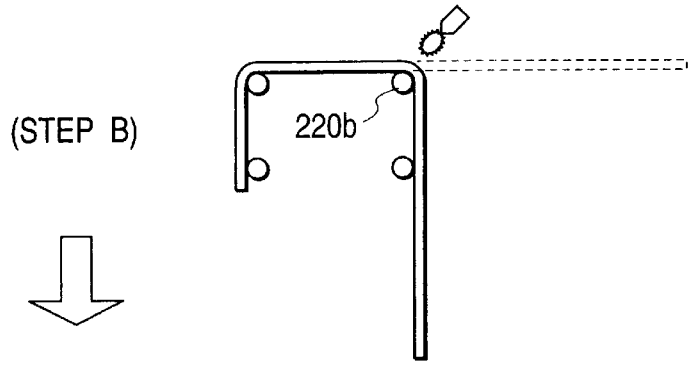
Figure 6C:
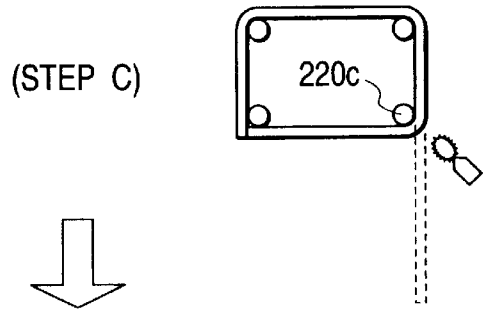
Figure 6D:
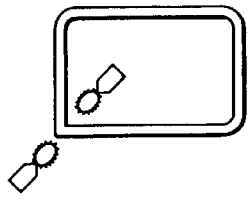

FIGS. 5A and 5B are views which illustrate the second frame 211. The outer dimension of the second frame 211 is 96 mm×96 mm, 2 mm wide, and 2 mm thick, which is formed by soda lime glass.

Now, hereunder, in conjunction with FIGS. 6A to 6D, the description will be made of the method for forming the first frame 210 and the second frame 211.

At first, in FIGS. 6A to 6D, a reference numeral 216 designates a column member of soda lime glass having almost rectangular section, which is formed to be in agreement with the size of the first or second frame by use of the hot drawing method. Also, a reference numeral 217 designates a burner; 220*a*, 220*b*, 220*c*, and 220*d*, circular bending jigs which are arranged on the four locations, respectively, in order to form the four corners in accordance with the size of the first or second frames. The manufacture method has the four processes, that is, step A, step B, step C, and step D.

Now, at first, in the step A, the column member 216 is heated by use of the burner 217 on the portion in a specific length from one end of thereof to soften the column member 216 locally. Then, by use of the aforesaid bending jig 220*a*, this portion is bent substantially at right angles.

Then, in the step B, the portion, which is in a specific length from the portion thus bent in the step A, is heated by use of the burner 217. The column member 216 is locally softened to bend it substantially at right angles by use of the aforesaid jig 220*b*.

Then, in the step C, the portion, which is in a specific length from the portion thus bent in the step B, is heated by use of the burner 217. The column member 216 is locally softened to bend it substantially at right angles by use of the aforesaid jig 220*c*. In the steps A to C, the shape of the first or second frame is completed.

Subsequently, in the step D, the region where both ends of the column member 216 thus processed are in contact with each other is heated by use of the burner 217 to fuse them to be welded, hence completing the first or second frame.

In this respect, those bent portions of the frame produced by the aforesaid method are slightly raised. However, there is no problem, because those raised portions are absorbed by the frit glass when the frame is sealed by use thereof.

Also, the cut-off groove 215 of the first frame 210 is provided by means of hot press applied to the frame thus produced in the steps A to D.

Now, in conjunction of FIGS. 7A and 7B, the description will be made of another method for forming the first frame 210 and the second frame 211 described above.

Figure 7A:
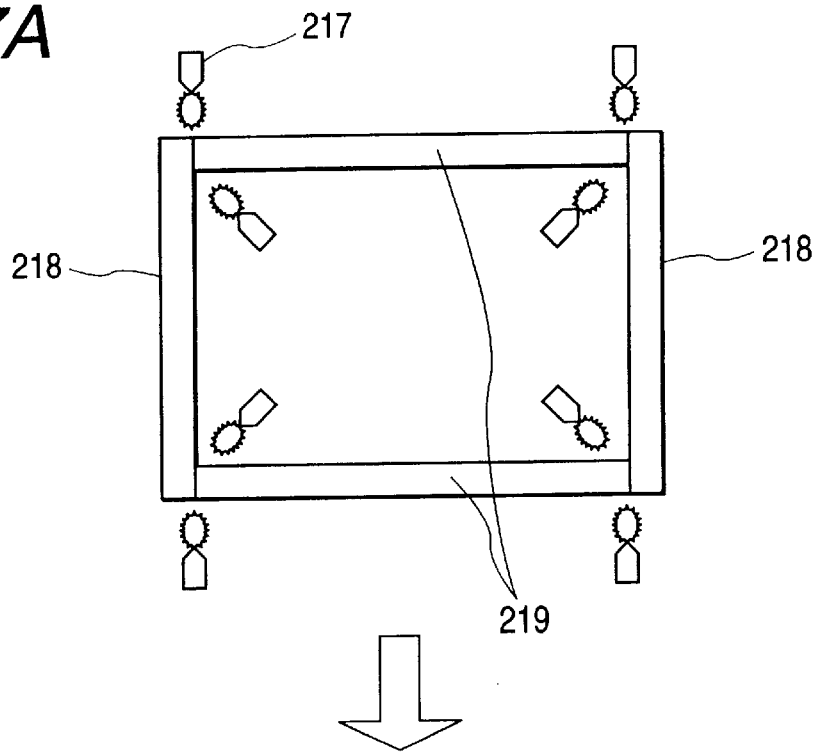
FIGS. 7A and 7B are views which illustrate a second method for forming the first and second frames.
Figure 7B:
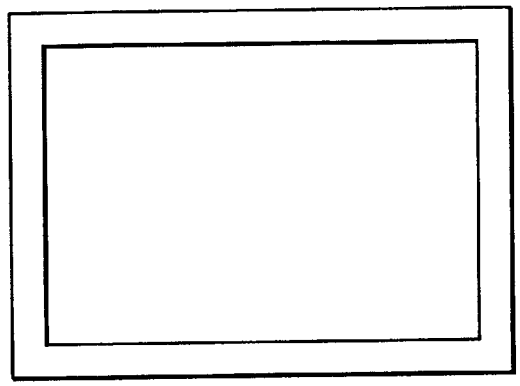

In FIGS. 7A and 7B, reference numerals 218 and 219 designate plate members formed by the soda lime glass whose section is almost rectangular. These members are produced to be in agreement with the size of the first or second frame. Here, such plate members are processed by use of the hot drawing method or by a method of cutting them out from a glass substrate. Also, reference numeral 217 designates a burner.

Each two of the plate members 218 and 219 are arranged in a rectangle to be positioned and fixed. Then, each contacted portion is heated by use of the burner 217 to be fused and welded. Here, it may be possible to assemble four or more plate members or it may be possible to assemble two plate members each of which is bent at one location, respectively, by means of the method described in conjunction with FIGS. 6A to 6D.

Now, the vacuum container 206 is produced in the following manner by use of the first or second frame formed by the method described above.

The face substrate 201 is set with the phosphor 204 placed upward in the vacuum chamber (not shown) in it. Then, on this substrate, the first outer frame 210 is arranged on the frit glass 207, and the second outer frame 211 is arranged on the frit glass 207. Further, the twelve first getters 231 are arranged in the position that becomes the first interframe space 222. Lastly, the rear substrate 202 having the electron-emitting device 205 placed downward is mounted, which is positioned by use of the jigs, and fixed also by use of the jig (not shown). After that, the interior of the chamber is evacuated to $10^{-5}$ Pa or less. Then, the temperature is raised in two hours up to 420° C. which is the temperature at which the frit glasses are bonded. After the temperature is kept at 420° C. in a period of 30 minutes, it is cooled down to the room temperature in two hours. The vacuum in the vacuum chamber is then broken to withdraw the vacuum container 206. In this manner, the manufacture of the vacuum container 206 shown in FIG. 1A is completed.

The vacuum degree of the imaging space 211 and the interframe space 222 is the same as that of the interior of the chamber, which is $10^{-5}$ Pa or less. Then, after that, the first getters 231 are activated by means of the high frequency heating to enable them to perform as a vacuum pump.

The first getters 231 absorb the discharged gas generated in the imaging space 221 from the structural members to maintain the vacuum, and also, absorb the gas due to the slow leakage from the bonded portions between the second frame 211, the face substrate 201, and the rear substrate 202 simultaneously, hence maintaining the vacuum.

In accordance with the present embodiment, the frame of 2 mm wide is doubled at an interval of 2 mm to make it possible to obtain a robustness equivalent to 6 mm. With the arrangement of the multiple frame structure as in the present embodiment, the robustness of the edge portions of the vacuum container is enhanced, while the weight thereof is reduced by an amount equivalent to that of the frame of 1 mm wide.

Thereafter, the operation, such as disclosed in the specification of Japanese Patent Application Laid-Open No. 7-235255, is carried out to incorporate the vacuum container into the housing. Then, the external driving circuit used for the image output is installed to manufacture the flat image display apparatus.

For the present embodiment, the description has been made of the utilization of soda lime glass as the material of each substrate glass and frame. However, it is possible to obtain the same effect even by use of the high strain point glass represented by PD-200.

For the present embodiment, the description has been made of the cut-out groove 215 as the twelve rectangles each having a width of 5 mm. However, the present invention is not necessarily limited to the rectangular grooves. It should be good enough if only the imaging space 221 and the first interframe space 222 are arranged to be continuous. The configuration thereof may be the U-letter shape, the V-letter shape, through hole, or the like.

In accordance with the present embodiment, the kind of getter is the Ba ring getter. However, the present invention is not necessarily limited to this kind of getter. In other words, it may be possible to adopt non-evaporation getter. It should be good enough if only the first getters 231 are arranged in the first interframe space 222. The same effect is obtainable.

Also, for the present embodiment, the description has been made of the use of the surface electron-emitting device as the required electron emitting device. However, the kind of the electron emitting device is not necessarily limited to the surface electron-emitting device. The same effect is obtainable even by the flat image display apparatus that uses the field emission electron-emitting device or the one that adopts the vacuum fluorescent display tube that uses thermoelectron.

Second Embodiment

FIGS. 8A, 8B, 9A and 9B are views which illustrate a vacuum container, a method of manufacture therefor, and a flat image display apparatus in accordance with another embodiment of the present invention.

What differs from the first embodiment is the configuration of the first frame used for the present embodiment.

Figure 8A:
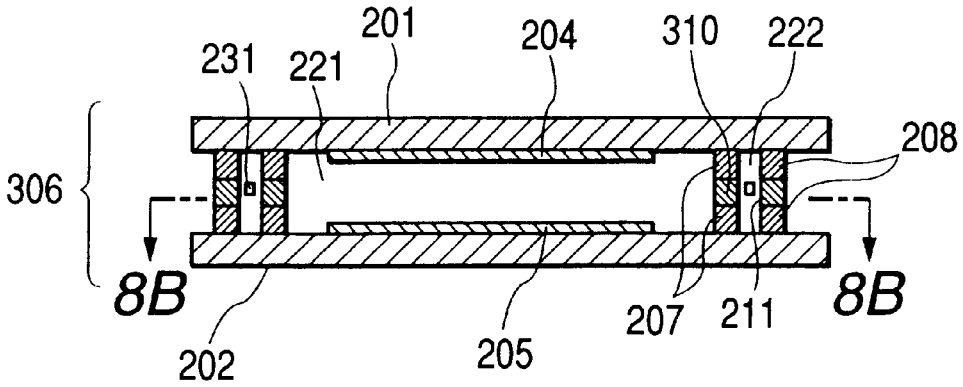
FIGS. 8A and 8B are views which illustrate a second embodiment in accordance with the present invention.
Figure 8B:
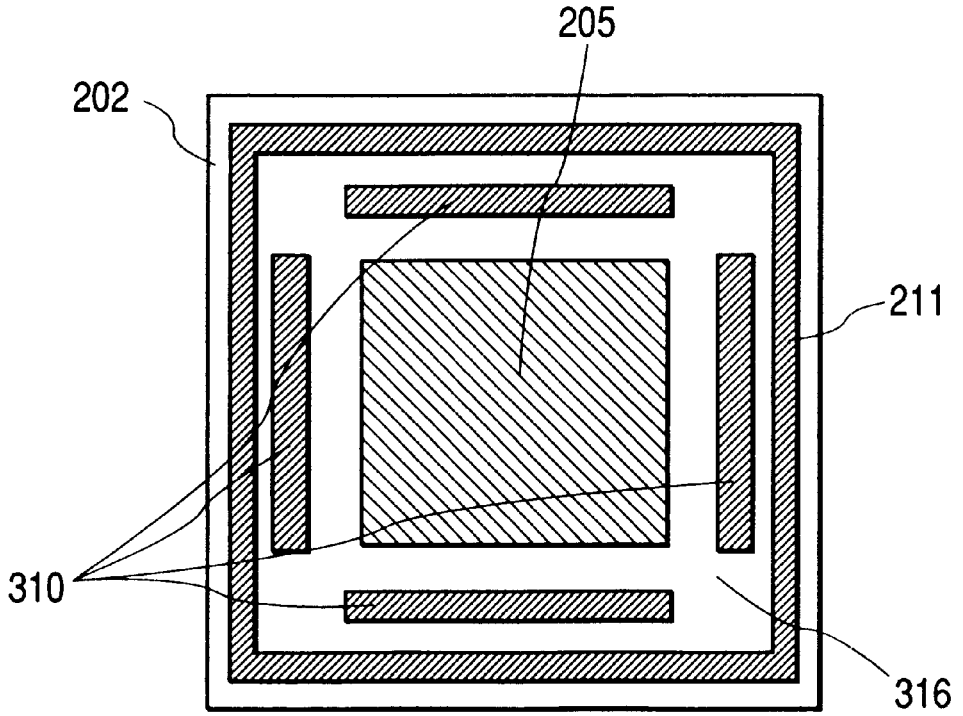

FIGS. 8A and 8B are views which illustrate the vacuum container 306 of the flat image display apparatus in accordance with the present embodiment. In FIGS. 8A and 8B, a reference numeral 310 designates the first frame arranged between the face substrate 201 and the rear substrate 202. All others are the same as those appearing in FIGS. 1A and 1B.

Figure 9A:
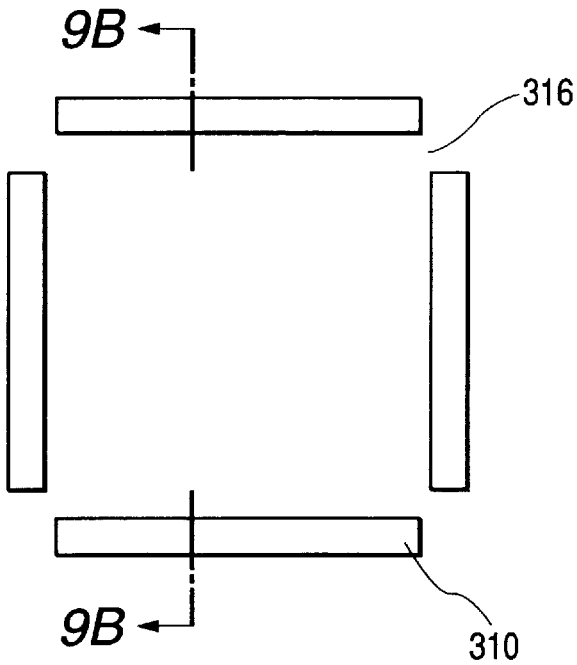
FIGS. 9A and 9B are views which illustrate the second embodiment, showing particularly the first frame 310 in FIGS. 8A and 8B.
Figure 9B:
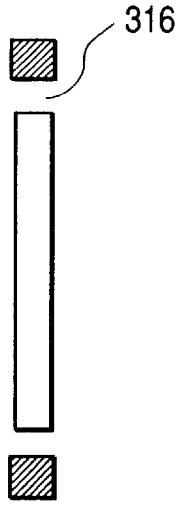

FIGS. 9A and 9B are views which illustrate the first frame 310. The first frame 310 is formed by combining the four plates each having 80 mm long, 2 mm wide, and 2 mm thick. There is arranged a gap 316 which makes the imaging space 211 and the first interframe space 222 a continuous space. The gap 316 has a width of approximately 5 mm.

Here, the material of the frame is high strain point glass, such as PD-200.

Now, the method of manufacture will be described.

At first, the frit glasses 207 and 208 are coated on the rear substrate 202 and the face substrate 201 by use of a dispenser in a width of 2 mm at a height of 0.2 mm. The shape of the frit glass is the same as that of the first frame 310 and the second frame 211, and the arrangement position thereof is the position where the frame should be positioned.

In this respect, the second frame 211 used for the present embodiment is also produced as in the first embodiment.

Then, the face substrate 201 is set with the phosphor 204 placed upward in the vacuum chamber (not shown) in it. Then, on this substrate, the first outer frame 310 is arranged on the frit glass 207, and the second outer frame 211 is arranged on the frit glass 207. Further, the first getters 231 are arranged in the position corresponding to the first interframe space 222. Then, the rear substrate 202 is mounted with the electron-emitting device 205 placed downward, which is positioned by use of the jigs, and fixed also by use of the jig (not shown). After that, the interior of the chamber is evacuated to $10^{-5}$ Pa or less. Then, the bonding operation is executed as described in conjunction with the first embodiment, thus completing the manufacture of the vacuum container 306 shown in FIGS. 8A and 8B.

The vacuum degree of the imaging space 211 and the interframe space 222 is the same as that of the interior of the chamber, which is $10^{-5}$ Pa or less. Then, after that, the first getters 231 are activated by means of the high frequency heating to enable them to perform as a vacuum pump.

In accordance with the present embodiment, the frame of 2 mm wide is doubled at an interval of 2 mm to make it possible to obtain a robustness equivalent to 6 mm. With the arrangement of the multiple frame structure as in the present embodiment, the robustness of the edge portions of the vacuum container is enhanced, while the weight thereof is reduced by an amount equivalent to that of the frame of 1 mm wide.

Thereafter, the operation, such as disclosed in the specification of Japanese Patent Application Laid-Open No. 7-235255, is carried out to incorporate the vacuum container into the housing. Then, the external driving circuit used for the image output is installed. In this way, the flat image display apparatus is manufactured.

For the present embodiment, the description has been made of the utilization of the high strain point glass as the material of the substrate glasses and frame. However, it is possible to obtain the same effect even by use of the soda lime glass.

For the present embodiment, the description has been made of the four gaps 316 of approximately 5 mm each for use. However, the present invention is not necessarily limited to the number of gaps and the size described above. It should be good enough if only the imaging space 221 and the first interframe space 222 are arranged to be continuous.

In other words, the first frame 310 is not necessarily formed by the four frame members. It may be possible to form the first frame by a plurality of frame members more than four.

In accordance with the present embodiment, the kind of getter is the Ba ring getter. However, the present invention is not necessarily limited to this kind of getter. In other words, it may be possible to adopt non-evaporation getter. It should be good enough if only the first getters 231 are arranged in the first interframe space 222. The same effect is obtainable.

Also, for the present embodiment, the description has been made of the use of the surface electron-emitting device as the required electron emitting device. However, the kind of the electron emitting device is not necessarily limited to the surface electron-emitting device. The same effect is obtainable even by the flat image display apparatus that uses the field emission electron-emitting device or the one that adopts the vacuum fluorescent display tube that uses thermoelectron.

Third Embodiment

Figure 10A:
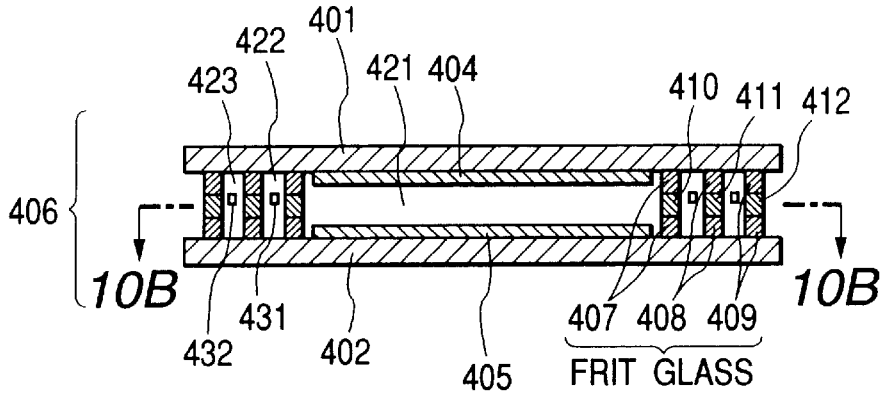
FIGS. 10A and 10B are views which illustrate a third embodiment in accordance with the present invention.
Figure 10B:
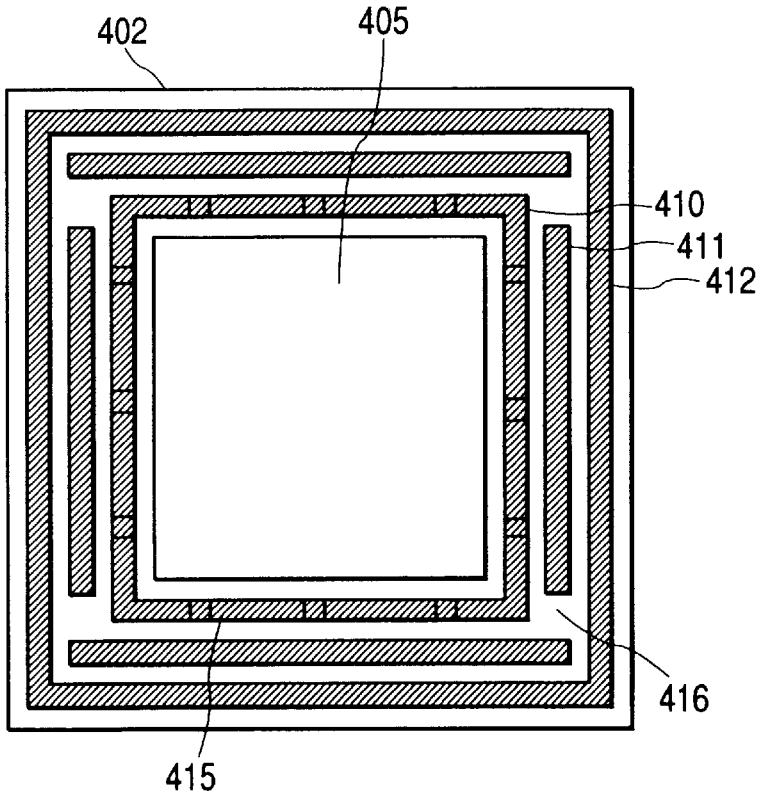

FIGS. 10A and 10B are views which illustrate a vacuum container, a method of manufacture therefor, and the flat image display apparatus which utilizes such vacuum container in accordance with still another embodiment of the present invention.

In FIGS. 10A and 10B, a reference numeral 401 designates the face substrate (soda lime glass of 94 mm×94 mm and 2.3 mm thick) having the phosphor 404 mounted thereon; 402, the rear substrate (soda lime glass of 94 mm×94 mm and 2.3 mm thick) mounting on it the electron-emitting device 405 which is called the surface conduction electron-emitting device; 410, the first frame (soda lime glass of 74 mm outer appearance×2 mm wide, and 2 mm thick) which is arranged between the face substrate 401 and the rear substrate 402; 411, the second frames (soda lime glass of 82 mm×2 mm×4 pieces, each in a thickness of 2 mm) arranged between the face substrate 401 and the rear substrate 202, which enclose the first frame 410; and 412, the third frame (soda lime glass of 90 mm×90 mm outer appearance×2 m wide and 2 mm thick) arranged between the face substrate 401 and the rear substrate 402, which encloses the second frames 411.

A reference numeral 407 designates the frit glass used for bonding the face substrate 401 and the rear substrate 402 and the first frame 410; 408, the frit glass used for bonding the face substrate 401, the rear substrate 402, and the second frames 411; 409, the frit glass used for bonding the face substrate 401, the rear substrate 402, and the third frame 412; and 406, the vacuum container formed by the face substrate 401, the rear substrate 402, the first frame 410, the second frames 411, the third frame 412, and the frit glasses 407, 408, and 409.

A reference numeral 421 designates the imaging space surrounded by the first frame 410, the face substrate 402 and the rear substrate 402, which is in contact with the phosphor 404 and the electron-emitting device 405; 422, the first interframe space surrounded by the first frame 410, the second frames 411, the face substrate 401, and the rear substrate 402; and 423, the second interframe space surrounded by the second frames 411, the third frame 412, the face substrate 401, and the rear substrate 402.

A reference numeral 415 designates twelve cut-out grooves which are arranged for the first frame 411 in a width of 3 mm each; 416, a gap of approximately 4 mm between the second frames 412, which is structured to be each of the gaps between four frame members; 431, the first getter which is arranged in the first interframe space 422; and 432, the second getter which is arranged in the second interframe space 423. The getters are the Ba ring getters which are supported by the getter supporting members (not shown).

In this respect, the first frame 410 and the third frame 412 of the present embodiment are produced in the same method adopted for the first embodiment.

Now, the method of manufacture will be described.

At first, the frit glasses 407, 408, and 409 are coated on the rear substrate 402 and the face substrate 401 by use of the dispenser in a width of 2 mm and at a height of 0.2 mm. The frit glasses are substantially in the same shapes of the first frame 410, the second frame 411, and the third frame 412, the setting positions of which are those where the frames are installed.

Then, in the vacuum chamber (not shown), the face substrate 401 is set with the phosphor 404 placed upward. On it, the first outer frame 410 is placed on the frit glass 407. After that, the second outer frames 411 are placed on the frit glass 408, and the third outer frame 412 is placed on the frit glass 409. Further, the first getter 431 is placed in a position corresponding to the first interframe space 422. The second getter 432 is placed in a position corresponding to the second interframe space 423. Further, the rear substrate 402 is set with the electron-emitting device 405 placed downward. Then, by use of jigs, the positioning is carried out to fix them by use of jigs (not shown). Subsequently, the interior of the chamber is evacuated to $10^{-5}$ Pa or less. Thus, as described in conjunction with the first embodiment, the bonding is made to complete the manufacture of the vacuum container 306 shown in FIGS. 10A and 10B.

The vacuum degree of the imaging space 421 and the first and second interframe space 422 and 423 are the same as that of the interior of the chamber, which is $10^{-5}$ Pa or less. Then, after that, the first and second getters 431 and 432 are activated by means of the high frequency heating to enable them to perform as a vacuum pump.

The first getter 431 absorbs the out gas generated mainly in the imaging space 421 from the structural members thereof, and the second getter 432 absorbs the gas due to the slow leakage mainly from the bonded portions between the third frame and the substrates. As a result, the period in which the vacuum is maintained is extended and the reliability is also enhanced as compared with the conventional getters.

Then, thereafter, the operation, such as disclosed in the specification of Japanese Patent Application Laid-Open No. 7-235255, is carried out to incorporate the vacuum container into the housing. Also, the external driving circuit used for the image output is installed to manufacture the flat image display apparatus whose weight is lighter than that of the conventional one.

For the present embodiment, the description has been made of the utilization of soda lime glass as the material of each substrate glass and frame. However, it is possible to obtain the same effect even by use of the high strain point glass represented by PD-200.

For the present embodiment, the description has been made of the four gaps 316 of approximately 5 mm each. However, both the number of the gaps and the size are not necessarily limited to them. It should be good enough if only the imaging space 421 and the first interframe space 422 are arranged to be continuous. In other words, the second frames 411 are not necessarily formed by four frame members, but may be formed by plural frame members of more than four.

In accordance with the present embodiment, the kind of getter is the Ba ring getter. However, the present invention is not necessarily limited to this kind of getter. In other words, it may be possible to adopt non-evaporation getter. It should be good enough if only the first getter 431 is arranged in the first interframe space 422. The same effect is obtainable.

Also, for the present embodiment, the description has been made of the use of the surface electron-emitting device as the required electron emitting device. However, the kind of the electron emitting device is not necessarily limited to the surface electron-emitting device. The same effect is obtainable even by the flat image display apparatus that uses the field emission electron-emitting device or the one that adopts the vacuum fluorescent display tube that uses thermoelectron.

Fourth Embodiment

Figure 11A:
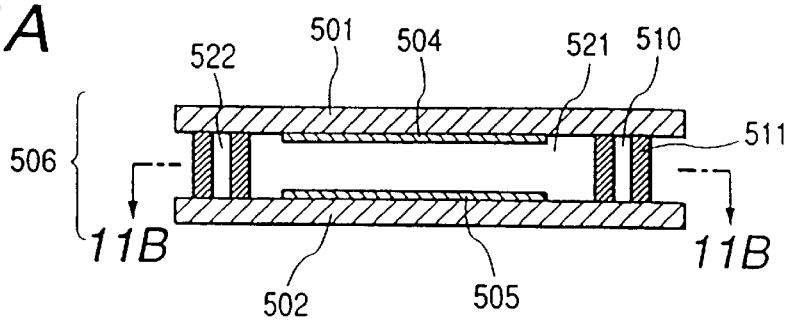
FIGS. 11A and 11B are views which illustrate a fourth embodiment in accordance with the present invention.
Figure 11B:
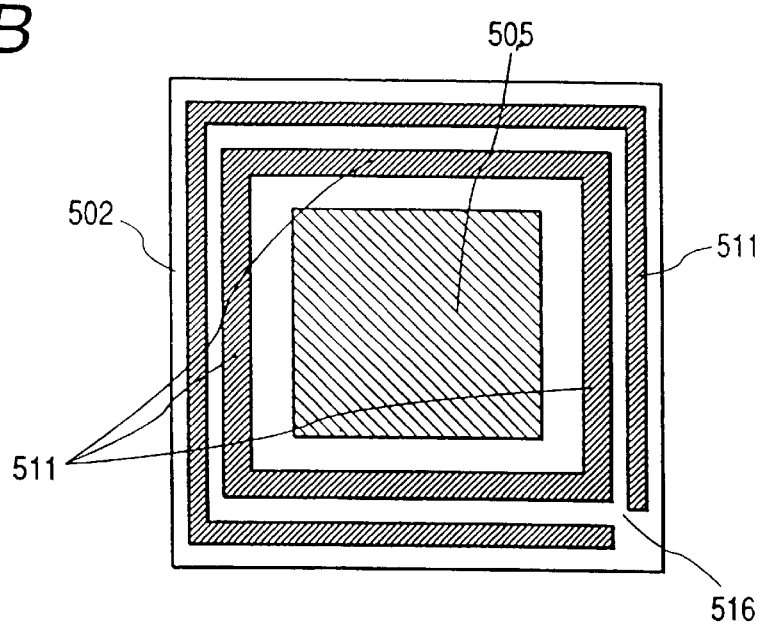
Figure 12:
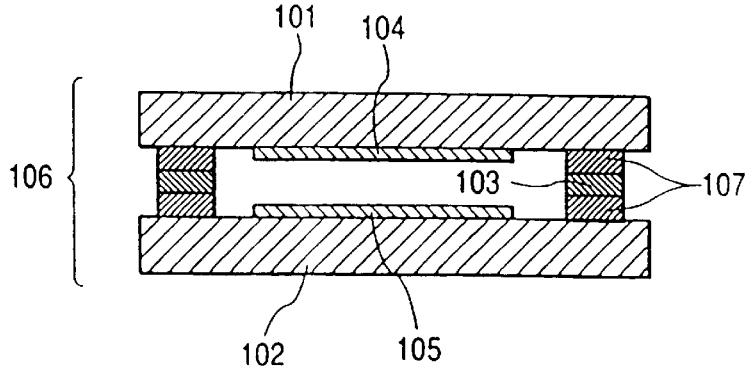
FIG. 12 (PRIOR ART)
FIG. 12 is a cross-sectional view which illustrates the conventional vacuum container.

FIGS. 11A and 11B are views which illustrate a vacuum container, a method of manufacture therefor, and a flat image display apparatus which utilizes such vacuum container in accordance with still another embodiment of the present invention.

FIGS. 11A and 11B are views which illustrate the FED vacuum container serving as a flat image display apparatus. In FIGS. 11A and 11B, a reference numeral 501 designates the face substrate (soda lime glass of 100 mm×100 mm and 2.3 mm thick) having the phosphor 504 mounted thereon; 502, the rear substrate 501 (soda lime glass of 100 mm×100 mm and 2.3 mm thick) mounting on it the electron-emitting device 505 which is called the field emission electron-emitting device; 510, the first frame formed by frit glass, which is arranged between the face substrate 501 and the rear substrate 502; 511, the second frame formed by frit glass, which is arranged between the face substrate 501 and the rear substrate 502, and encloses the first frame 510; and 506, the vacuum container which is formed by the face substrate 501, the rear substrate 502, the first frame 510, and the second frame 511.

A reference numeral 521 designates the imaging space surrounded by the first frame 510, the face substrate 501, and the rear substrate 502, which is in contact with the phosphor 504 and the electron-emitting device 505; and 522, the first interframe space surrounded by the first frame 510, the second frame 511, the face substrate 501 and the rear substrate 502. A reference numeral 516 designates the gap which is arranged for the second frame 512 to connect the first interface space and the outer space of the vacuum container 506.

In this respect, the first frame 511 of the present embodiment is also produced in the same method adopted for the first embodiment. Then, the second frame 511 is produced by the bending method described for the first embodiment in conjunction with FIGS. 6A to 6D.

Now, the method of manufacture will be described.

At first, first glass is coated in advance on the rear substrate 502 mounting on it the electron-emitting device 505 by use of the dispenser in a width of 2 mm and thickness of 0.4 mm to make this substrate the first fame 510 which becomes an air-tight frame. Then, frit glass is coated by use of dispenser in a width of 2 mm and a thickness of 0.4 mm, and also, with the gap 516 of 5 mm, the second frame 511 is made. The outer dimension of the first frame 510 is 88 mm×88 mm, and the outer dimension of the second frame 511 is 96 mm×96 mm.

Then, in the vacuum chamber (not shown), the rear substrate 502 is set with the electron-emitting device 505 placed upward, and the face substrate 501 is mounted, having the phosphor 504 and others placed downward with the first outer frame 510 and the second outer frame 511 sandwiched between them. After these members are positioned and fixed by use of jigs (not shown), the interior of the chamber is evacuated to $10^{-5}$ Pa or less. Subsequently, the temperature is raised in two hours up to 420° C. which is the temperature at which the frit glass is bonded. After the temperature is kept at 420° C. in a period of 30 minutes, it is cooled down to the room temperature in two hours. The vacuum in the vacuum chamber is then broken to withdraw the vacuum container 506 to complete the manufacture of the vacuum container 506 shown in FIGS. 11A and 11B. In this way, the vacuum container can be manufactured with the highly robust edge circumference thereof. Then, the operation, such as disclosed in the specification of Japanese Patent Application Laid-Open No. 7-235255, is carried out to incorporate the vacuum container into the housing. Also, the external driving circuit used for the image output is installed to manufacture the flat image display apparatus whose weight is lighter than that of the conventional one.

For the present embodiment, the description has been made of the utilization of soda lime glass as the material of each substrate glass and frame. However, it is possible to obtain the same effect even by use of the high strain point glass represented by PD-200.

For the present embodiment, the description has been made of the gap 516 of approximately 5 mm, but the present invention is not necessarily limited to this gap arrangement. It should be good enough if only the first interframe space 522 is made a space which is connected with the outside of the vacuum container continuously.

Also, for the present embodiment, the description has been made of the use of the filed emission electron-emitting device as the required electron emitting device. However, the kind of the electron emitting device is not necessarily limited to the field emission electron-emitting device. The same effect is obtainable even by the flat image display apparatus that uses the surface conduction electron-emitting device or the one that adopts the vacuum fluorescent display tube that uses thermoelectron.

As described above, in accordance with the present invention, it is possible to manufacture a light weight vacuum container at lower costs, as well as a flat image display apparatus, because, with the provision of a plurality of frame members for the outer frame portion, thinner substrates can be utilized with a good sealing mechanism, while securing the sufficient robustness of the edge circumference of the vacuum container.

Also, in accordance with the present invention, it is possible to manufacture a light weight vacuum container at lower costs, as well as a flat image display apparatus, because, with the provision of a plurality of frame members for the outer frame portion, the aforesaid frame members can secure the sufficient robustness of the edge circumference of the vacuum container with a good sealing mechanism even when using the thinner substrates which can be easily bent for formation for the frame members to be processed by the bending operation.

Also, in accordance with the present invention, it is possible to manufacture a light weight vacuum container at lower costs, as well as a flat image display apparatus, because, with the provision of a plurality of frame members for the outer frame portion, the aforesaid frame members can secure the sufficient robustness of the edge circumference of the vacuum container and a good sealing mechanism without any particular attention given to the leakage from the bonding portions even when using the frame members which are formed by bonding a plurality of substrates.

What is claimed is:

1. A vacuum container for a flat image display apparatus, comprising:

a rear substrate having an electron-emitting device mounted thereon;

a face substrate arranged to face said rear substrate, having thereon a phosphor emitting light when the electron emitted from said electron-emitting device collides therewith; and an outer frame arranged between said face substrate and said rear substrate, wherein said outer frame is provided with a first frame member enclosing said electron-emitting device, and a second frame member enclosing said first frame member, and said first frame member, said face substrate, and said rear substrate surround and form a first imaging space, and said first frame member, said second frame member, said face substrate, and said rear substrate surround and form a first interframe space, and wherein getter means is arranged in said first interframe space.

2. A vacuum container according to claim 1, wherein said outer frame is provided further with a third frame member enclosing said second frame member, and said second frame member, said third frame member, said face substrate, and said rear substrate surround and form a second interframe space.

3. A vacuum container according to claim 2, further comprising getter means arranged in said second interframe space.

4. A vacuum container according to claim 1, wherein a cut-out structure is provided for said first frame member, and said imaging space and said first interframe space are continuous.

5. A vacuum container according to claim 1, wherein said imaging space and said first interframe space are independent.

6. A vacuum container according to claim 2, wherein a cut-out structure is provided for said second frame member, and said first interframe space and said second interframe space are continuous.

7. A vacuum container according to claim 2, wherein said first interframe space and said second interframe space are independent.

8. A vacuum container according to claim 6, wherein said cut-out structure is a cut-out groove.

9. A vacuum container according to claim 8, wherein said cut-out structure is a cut-out groove.

10. A vacuum container according to claim 6, wherein said cut-out structure is a gap.

11. A vacuum container according to claim 8, wherein said cut-out structure is a gap.

12. A vacuum container according to claim 1, wherein a non-air-tight frame is provided for an outer side of said air-tight-frame.

13. A vacuum container according to claim 1, wherein said first and second frame members are glass.

14. A vacuum container according to claim 13, wherein said first and second frame members are frit glass.

15. A vacuum container according to claim 1, wherein said electron-emitting device is a surface conduction electron-emitting device.

16. A vacuum container according to claim 1, wherein said electron-emitting device is a field emission electron-emitting device.

17. A flat image display apparatus comprising a vacuum container according to any one of claims 1, 2, 3–11, 12–14, 15 and 16.

18. A vacuum container according to claims 2, wherein said third frame member is a glass.

19. A vacuum container according to claim 2, wherein said third frame is frit glass.

* * * * *

UNITED STATES PATENT AND TRADEMARK OFFICE

CERTIFICATE OF CORRECTION

PATENT NO. : 6,605,893 B2
DATED : August 12, 2003
INVENTOR(S) : Tomokazu Ando

It is certified that error appears in the above-identified patent and that said Letters Patent is hereby corrected as shown below:

Column 10,
Line 11, “space” should read -- spaces --.

Column 11,
Line 5, “501” should be deleted.
Line 35, “fame” should read -- frame --.

Signed and Sealed this

Twentieth Day of January, 2004

JON W. DUDAS
*Acting Director of the United States Patent and Trademark Office*